United States Patent [19]

Chew

[11] Patent Number: 4,630,778

[45] Date of Patent: Dec. 23, 1986

[54] SEPARATION OF MIXTURES OF BITUMINOUS COAL AND LOWER RANK COAL BY SELECTIVE CHEMICAL COMMINUTION

[75] Inventor: Ju-Nam Chew, Dallas, Tex.

[73] Assignee: Mobil Oil Corporation, New York, N.Y.

[21] Appl. No.: 550,709

[22] Filed: Nov. 14, 1983

[51] Int. Cl.[4] ..... B02C 19/00

[52] U.S. Cl. ..... 241/1; 241/14; 241/24

[58] Field of Search ..... 241/1, 14, 24, 21

[56] References Cited

U.S. PATENT DOCUMENTS

| | | | |
|---|---|---|---|
| 2,189,711 | 2/1940 | Eigenbrot | 241/14 |
| 2,842,319 | 7/1958 | Reerink et al. | 241/14 |
| 3,815,826 | 6/1974 | Aldrich et al. | 241/1 |

*Primary Examiner*—Mark Rosenbaum

*Attorney, Agent, or Firm*—Alexander J. McKillop; Michael G. Gilman; Charles A. Malone

[57] ABSTRACT

Method for separating a mixture of bituminous coal and a lower rank coal such as subbituminous, lignite, and mixtures thereof, comprising contacting the coal mixture with an effective amount of an aqueous chemical comminuting solution for a sufficient time to selectively comminute a substantial portion of one of the ranks of coal in the mixture. Thereafter, the comminuted coal and noncomminuted coal of different rank is separated from the chemical comminuting solution. The smaller comminuted coal particles of one rank are then separated from the larger noncomminuted coal of the other rank by screening. Substantially anhydrous methanol or an aqueous methanol solution is used to selectively comminute the bituminous rank coal whereas an aqueous alkaline solution, preferably aqueous sodium hydroxide, is used to selectively comminute the lower rank coal.

11 Claims, 1 Drawing Figure

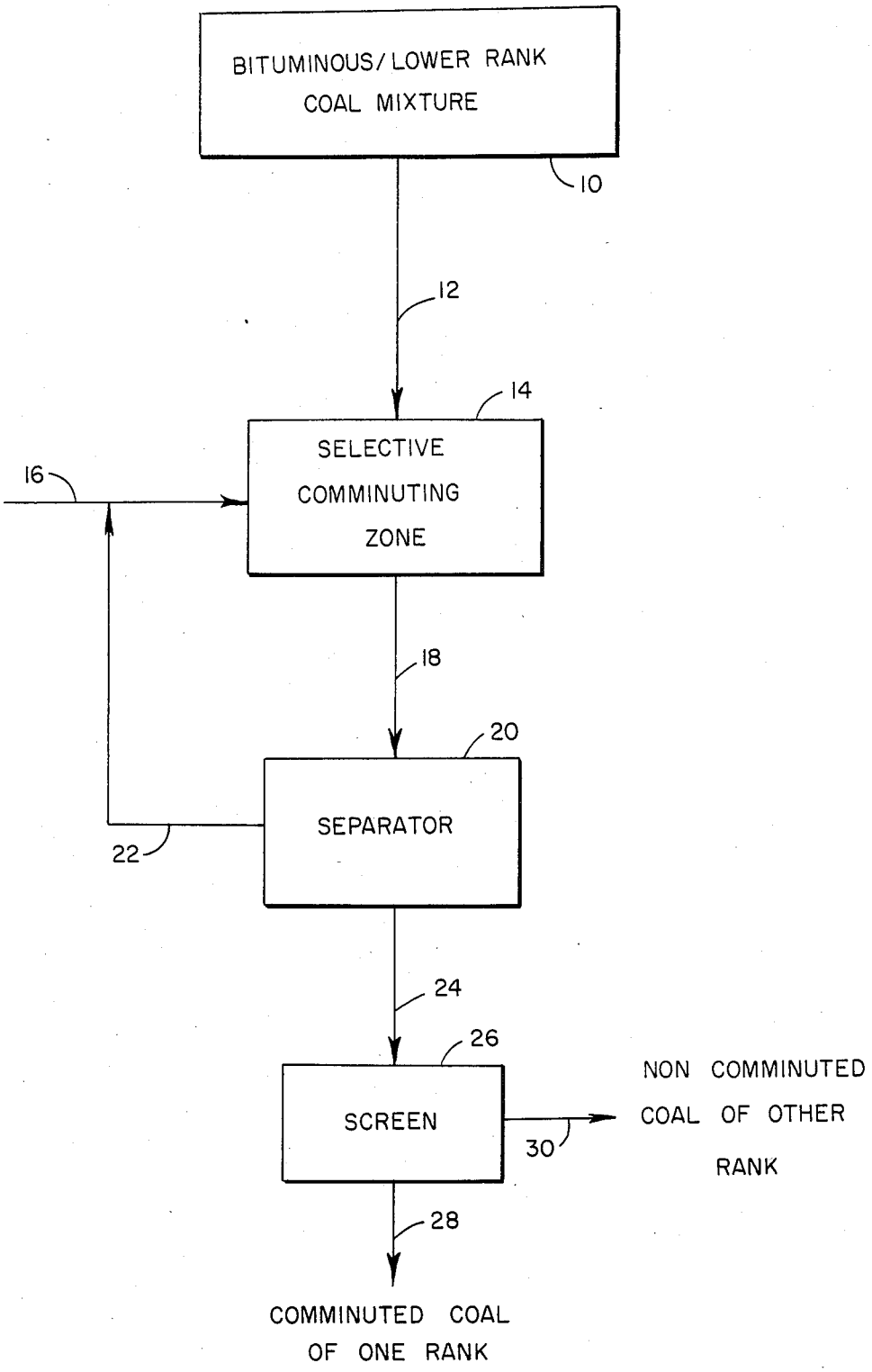
BITUMINOUS/LOWER RANK COAL MIXTURE
10
12
14
SELECTIVE COMMINUTING ZONE
16
18
20
SEPARATOR
22
24
26
SCREEN
30
NON COMMINUTED COAL OF OTHER RANK
28
COMMINUTED COAL OF ONE RANK

SEPARATION OF MIXTURES OF BITUMINOUS COAL AND LOWER RANK COAL BY SELECTIVE CHEMICAL COMMINUTION

BACKGROUND OF THE INVENTION

The invention relates to a method for separating a mixture of bituminous coal and a lower rank coal such as subbituminous, lignite and mixtures thereof. In particular, the invention provides a method for separating a mixture of bituminous coal and a lower rank coal by contacting the mixture with a chemical comminuting solution that selectively comminutes one rank of coal.

As the result of the declining availability of oil, more emphasis has been directed toward the problem of more effective utilization of coal. Two methods are generally used for removing coal from the ground, either strip mining, in which the coal is merely dug out of the ground by mechanical or hydraulic means and transferred to the place of use, or underground mining using methods such as slurry mining, room and pillar, or longwall. The types of commercially available coals consist of high rank coals ranging from the relatively pure and high carbon content anthracite coal through bituminous coal, and lower rank coals ranging from subbituminous coals to lignite and the like as well as mixtures thereof.

Comminution of coal into pieces of manageable size has been accomplished by mechanical means, explosives or by chemical means.

Processes for chemical comminution of coal, both above ground and below ground have been disclosed in U.S. Pat. Nos. 3,815,826 to Aldrich et al, 3,870,237 to Aldrich and 4,032,193 to Drinkard et al. According to these processes, the interlayer forces at natural interfaces present in the coal is weakened by contact with a number of reagents such as gaseous anhydrous ammonia, liquid anhydrous ammonia, aqueous ammonia, organic solvents, alcohols containing sodium hydroxide, and aqueous solutions of sodium hydroxide.

The present invention provides an effective method of separating a mixture of bituminous coal and lower rank coals utilizing a chemical comminuting solution that selectively comminutes one rank of coal in the mixture.

SUMMARY OF THE INVENTION

This invention is a process for separating a mixture of bituminous coal and a lower rank coal such as subbituminous, lignite and mixtures thereof, comprising the steps of contacting said coal mixture with an effective amount of a chemical comminuting solution and maintaining said contact for a time sufficient whereby the aqueous chemical comminuting solution selectively comminutes a substantial portion of one of said ranks of coal to a reduced particle size, recovering the comminuted and noncomminuted coal from the coal chemical comminuting solution, and separating the comminuted coal particles of one rank having reduced particle size from the noncomminuted coal of different rank. The chemical comminuting solution used for selectively comminuting the bituminous coal in the coal mixture is substantially anhydrous methanol or an aqueous methanol solution containing 10 to 90 volume percent methanol. The amount of methanol or aqueous methanol solution needed to effectively comminute the bituminous coal is an amount within the range of 0.3 parts to about 3 parts by weight of solution per part of bituminous coal. For selectively comminuting the lower rank coal in the coal mixture, and aqueous alkaline solution, preferably aqueous sodium hydroxide, is used at a concentration within the range of 0.04 to 20 wt. percent and in an amount within the range of 0.5 parts to about 5 parts by weight of solution per part of lower rank coal.

BRIEF DESCRIPTION OF THE DRAWING

The FIGURE of the drawing is a flow diagram showing a preferred embodiment of the present process.

DESCRIPTION OF THE PREFERRED EMBODIMENTS

Referring to the drawing, a mixture of bituminous coal and a lower rank coal such as subbituminous, lignite and mixture thereof at a coal source point 10 is introduced via line 12 to a comminuting zone 14 where the coal mixture is contacted with a chemical comminuting solution introduced via line 16 for a sufficient time to selectively comminute a substantial portion of one of the ranks of coal to a reduced particle size. Thereafter, the comminuting chemical solution containing comminuted coal of one rank and noncomminuted coal of the other rank in the form of a slurry is passed via line 18 to a solid/liquid separator 20 wherein the aqueous chemical comminuting solution is separated from the solid comminuted and noncomminuted coal by deslurrying it. Since the slurry is a solid-liquid mixture, it is possible to use such conventional dewatering equipment as solid bowl centrifuges or liquid-solid cyclone separators operating under pressure to deslurry the mixture of comminuted and noncomminuted coal. The chemical comminuting solution is recovered from the separator via line 22 and recycled to the comminuting zone 14 via line 16. The solid mixture of comminuted coal of one rank and the noncomminuted coal of the other rank is removed from separator 20 via line 24 and passed to a screen 26 that separates the smaller comminuted coal particles from the larger noncomminuted coal particles. The comminuted coal particles of selected rank are recovered from the screen via line 28 and the noncomminuted coal particles of the other rank are recovered from the screen via line 30. The recovered bituminous coal or lower rank coal can be used as fuel or for other purposes depending upon the rank of coal desired.

In order to selectively comminute the bituminous rank of coal in the mixture, the chemical comminuting solution is substantially anhydrous methanol or an aqueous methanol solution. The concentration of methanol in the solution is within the range of 10 to 90 volume percent, prefereably 50 to 75 percent by volume. The amount of anhydrous methanol or aqueous methanol solution needed to effectively comminute the bituminous coal in the mixture of coal in the comminution zone 14 is within the range of 0.3 part to about 3 parts by weight of solution per part of bituminous coal in the coal mixture and preferably 1 part by weight of solution per part of bituminous rank.

In order to selectively comminute the lower rank coal comprising subbituminous, lignite or mixtures thereof, the aqueous chemical comminuting solution is an aqueous alkaline solution such as hydroxides of the alkaline metals, i.e. sodium, lithium, potassium, and the like such as carbonates. Of these sodium hydroxide is preferred. The aqueous alkaline solutions useful for comminuting the lower rank coal in the coal mixture vary in strength from a lower range of about 0.04 percent by weight of the alkaline substance, to an upper range of about 20 percent by weight of the alkaline substance, and preferably about 5 percent by weight. The amount of aqueous alkaline solution needed to effectively comminute the lower rank portion of the coal mixture is within the range of 0.5 part to about 5 parts by weight of solution per part of the lower rank coal in the coal mixture and preferably 2 parts by weight of solution per part of coal.

The present invention is particularly effective for separating mixtures of bituminous coal and lower rank coals wherein the particle size of the coal mixture is substantially uniform and the average particle size of the coal is within the range of ¼ to 2 inches.

This invention will be further illustrated by the following specific examples:

EXAMPLE 1

The selective comminution of bituminous coal using anhydrous methanol is illustrated by the following example:

Plugs 1 inch dia.×0.25 inch thick were cut from samples of low rank coals from a prospect near Buffalo, Wyo. Specimens cut normal as well as parallel to the bedding planes were prepared and placed in individual beakers containing methanol at room temperature. A sample of a high rank coal from Catlinville, Ill. area was also selected and immersed in methanol. These specimens were left undisturbed for periods ranging from 1 day to 80 days and the degree of natural comminution recorded at frequent intervals. The results are summarized below:

TABLE 1

EFFECT OF COAL RANK ON COMMINUTION REACTIVITY IN 100% METHANOL

| | | DEGREE OF COMMINUTION AT INDICATED TIME (DAYS) | | | |
|---|---|---|---|---|---|
| RANK | SOURCE | 0.67 | 1 | 50 | 73 |
| bituminous | Illinois No. 6 | Fragmented | — | — | — |
| subbituminous "C" | Ucross | Intact | → | → | → |
| lignite | Cameron | Intact | → | → | → |
| lignite | Healy | Intact | → | → | → |

The above results show that in the case of bituminous coal, less than 1 day elapsed for significant breakage to occur with formation of coal fragments. It was observed this comminution resulted without any apparent change in the appearance of the methanol. Simply touching the coal produced additional fragmentation. By contrast, with the lower rank coals, after 73 days contact with 100% methanol, the only evidence of reactivity was a slight yellowish discoloration imparted to the alcohol. Thus the results clearly show that anhydrous methanol selectively comminutes the higher rank bituminous coal.

EXAMPLE 2

The comminution reactivity of a bituminous coal as a function of the proportion of methanol in an aqueous methanol solution is illustrated by the following example:

Specimens approximately 1.5 inch×1 inch×1 inch were cut from a larger sample of Illinois No. 6 coal, immersed in solutions containing from 5% (vol.) methanol to 100% (vol.) methanol, and left undisturbed for several days. Comminution reactivity was observed at a standardized time of 3 days' immersion; however fragmentation was evident at short times for solutions containing more than 10% (vol.) methanol. Results were analyzed in terms of a "Fragmentation Index" in which strong reactivity was given a rank of 10 and very weak reactivity was given a rank of 1. The results are summarized below:

TABLE 2

COMMINUTION REACTIVITY OF BITUMINOUS COAL IN AQUEOUS METHANOL SOLUTIONS

| VOL. % ALCOHOL IN MIX | FRAGMENTATION INDEX |
|---|---|
| 5 | 1 |
| 10 | 3 |
| 25 | 3 |
| 50 | 6 |
| 75 | 10 |
| 90 | 5 |
| 100 | 7 |

The above results show that fragmentation of bituminous coal occurs over a broad range of methanol concentrations, with substantial comminution occurring when the aqueous methanol solution contains about 75% by volume alcohol. However, fragmentation is also occurring when the alcohol content is of the order of 10% by volume.

EXAMPLE 3

The specific comminution of a lower rank coal such as subbituminous coal and lignite using an aqueous alkaline solution is illustrated by the following example:

For each of several ranks of coal, a batch of wedges or chunks each measuring at least 1 inch in the smallest dimension was placed in a glass jar and covered with a 1N sodium hydroxide solution. After 3 days' immersion, the following results were obtained:

TABLE 3

EFFECT OF COAL RANK ON COMMINUTION REACTIVITY IN 1N NaOH

| RANK | SOURCE | WEIGHT OF 1N COAL, g | WEIGHT OF COM-NaOH, g | DEGREE MINUTION |
|---|---|---|---|---|
| bituminous | Illinois No. 6 | 52.96 | 197.74 | Intact |
| subbit-uminous | Ucross | 140.36 | 307.48 | Fragmented |
| lignite | Cameron | 207.45 | 291.54 | Fragmented |
| lignite | Healy | 225.17 | 277.13 | Fragmented |

The bituminous coal sample above was still intact after 41 days' immersion in 1N NaOH.

What is claimed is:

1. A method for separating a mixture of bituminous coal and a lower rank coal comprising the steps of:

(a) contacting said coal mixture with an effective amount of a dilute aqueous methanol solution, of a strength of about 75 volume percent and sufficient to give substantially better comminution reactivity than substantially anhydrous methanol, and maintaining said contact for a time sufficient whereby said methanol selectively comminutes a substantial portion of bituminous coal to a reduced particle size;

(b) separating the comminuted bituminous coal of one rank and noncomminuted coal of the other rank from said methanol comminuting solution; and (c) separating the comminuted coal particles of one rank from the noncomminuted coal of the other rank.

2. The method of claim 1 wherein the ratio of aqueous methanol solution to bituminous coal in the coal mixture is within the range of 0.3 to 3 parts by weight of solution per part of bituminous coal in said coal mixture.

3. The method of claim 1 including the step of returning the chemical comminuting solution from step (b) for reuse in selectively comminuting said coal according to step (a).

4. The method of claim 1 wherein the lower rank coal is subbituminous coal.

5. The method of claim 1 wherein the lower rank coal is lignite.

6. The method of claim 1 wherein the lower rank coal is a mixture of subbituminous coal and lignite.

7. A method for separating a mixture of bituminous coal and a lower rank coal comprising subbituminous, lignite and mixtures thereof, comprising the steps of:

(a) contacting said coal mixture with an effective amount of a dilute aqueous methanol solution, of a strength of about 75 volume percent and sufficient to give substantially better comminution reactivity than substantially anhydrous methanol, and maintaining said contact for a time sufficient whereby said methanol selectively comminutes a substantial portion of bituminous coal to a reduced particle size; and (b) separating the comminuted coal particles of one rank from the noncomminuted coal of the other rank.

8. The method of claim 7 wherein the ratio of aqueous methanol solution to bituminous coal in the coal mixture is within the range of 0.3 to 3 parts by weight of solution per part of bituminous coal in said coal mixture.

9. The method of claim 7 wherein the lower rank coal is subbituminous coal.

10. The method of claim 7 wherein the lower rank coal is lignite.

11. The method of claim 7 wherein the lower rank coal is a mixture of subbituminous coal and lignite.

* * * * *